US009149812B2

(12) United States Patent
Belotserkovskiy et al.

(10) Patent No.: US 9,149,812 B2
(45) Date of Patent: Oct. 6, 2015

(54) TRAMP MATERIAL INDICATION

(75) Inventors: Konstantin Belotserkovskiy, Malmo (SE); Mikhail Shirkin, St. Petersburg (RU)

(73) Assignee: Sandvik Intellectual Property AB, Sandviken (SE)

( * ) Notice: Subject to any disclaimer, the term of this patent is extended or adjusted under 35 U.S.C. 154(b) by 16 days.

(21) Appl. No.: 14/126,537

(22) PCT Filed: May 29, 2012

(86) PCT No.: PCT/EP2012/059975

§ 371 (c)(1),
(2), (4) Date: Dec. 16, 2013

(87) PCT Pub. No.: WO2012/171775

PCT Pub. Date: Dec. 20, 2012

(65) Prior Publication Data

US 2014/0117127 A1 May 1, 2014

(30) Foreign Application Priority Data

Jun. 17, 2011 (EP) ..... 11170323

(51) Int. Cl.
*B02C 25/00* (2006.01)
*B02C 2/04* (2006.01)
*B02C 2/00* (2006.01)

(52) U.S. Cl.
CPC ..... *B02C 25/00* (2013.01); *B02C 2/042* (2013.01); *B02C 2/00* (2013.01)

(58) Field of Classification Search
CPC ..... B02C 2/00; B02C 2/04; B02C 2/042; B02C 25/00
USPC ..... 241/35–37, 101.3, 207–216
See application file for complete search history.

(56) References Cited

U.S. PATENT DOCUMENTS

| | | | | |
|---|---|---|---|---|
| 3,300,149 | A | 1/1967 | Lemardeley et al. | |
| 3,754,716 | A * | 8/1973 | Webster | 241/208 |
| 4,272,030 | A | 6/1981 | Afanasiev et al. | |
| 4,478,373 | A * | 10/1984 | Gieschen | 241/208 |
| 8,496,195 | B2 * | 7/2013 | Sjoberg et al. | 241/37 |
| 2007/0051837 | A1 * | 3/2007 | Juhlin | 241/37 |
| 2010/0288862 | A1 * | 11/2010 | Wark | 241/37 |
| 2013/0001337 | A1 * | 1/2013 | Sjoberg et al. | 241/27 |
| 2014/0103150 | A1 * | 4/2014 | Belotserkovskiy | 241/27 |

* cited by examiner

*Primary Examiner* — Faye Francis
(74) *Attorney, Agent, or Firm* — Corinne R. Gorski

(57) ABSTRACT

A method for detecting tramp material in an inertia cone crusher having an outer crushing shell and an inner crushing shell is provided. The inner crushing shell is supported on a crushing head. The crushing head is rotatably connected to an unbalance bushing. The unbalance bushing has an unbalance weight for tilting the unbalance bushing when it is rotated, such that the crushing head will gyrate about a gyration axis, the inner crushing shell thereby approaching the outer crushing shell for crushing material in the crushing chamber formed therebetween. The method includes the steps of measuring at least one of a position and a motion of the crushing head; obtaining, based on the measurement, a gyration value; comparing the gyration value with a gyration reference value; and determining, based on the comparison, whether to issue a tramp material warning signal indicating the presence of tramp material in the crusher.

13 Claims, 6 Drawing Sheets

TRAMP MATERIAL INDICATION

RELATED APPLICATION DATA

This application is a §371 National Stage Application of PCT International Application No. PCT/EP2012/059975 filed May 29, 2012 claiming priority of EP Application No. 11170323.7, filed Jun. 17, 2011.

TECHNICAL FIELD OF THE INVENTION

The present invention relates to an inertia cone crusher comprising an outer crushing shell and an inner crushing shell, said inner and outer shells forming between them a crushing chamber, the inner crushing shell being supported on a crushing head, said crushing head being rotatably connected to an unbalance bushing, which is arranged to be rotated by a drive shaft, said unbalance bushing being provided with an unbalance weight for tilting the unbalance bushing when it is rotated, such that the central axis of the crushing head will, when the unbalance bushing is rotated by the drive shaft and tilted by the unbalance weight, gyrate about a gyration axis, the inner crushing shell thereby approaching the outer crushing shell for crushing material in the crushing chamber. The invention also relates to a method for detecting tramp material in such an inertia cone crusher.

BACKGROUND OF THE INVENTION

An inertia cone crusher may be utiliPMed for efficient crushing of material, such as stone, ore etc., into smaller siPMes. An example of an inertia cone crusher can be found in EP2116307. In such an inertia cone crusher, material is crushed between an outer crushing shell, which is mounted in a frame, and an inner crushing shell, which is mounted on a crushing head. The crushing head is mounted on a crushing head shaft. An unbalance weight is arranged on a cylindrical sleeve-shaped unbalance bushing encircling the crushing head shaft. The cylindrical sleeve is, via a drive shaft, connected to a pulley. A motor is operative for rotating the pulley, and, hence, the cylindrical sleeve. Such rotation causes the unbalance weight to rotate and to swing to the side, causing the crushing shaft, the crushing head, and the inner crushing shell to gyrate and to crush material that is fed to a crushing chamber formed between the inner and outer crushing shells.

It may happen that tramp material, for example metal parts that have fallen off upstream equipment, enters the crusher. Such tramp material will not be crushed by the crusher. Instead, the tramp material may damage or block the crusher, or pass through the crusher unnoticed and cause damage to downstream equipment.

SUMMARY OF THE INVENTION

It is an object of the present invention to solve, or at least mitigate, parts or all of the above mentioned problems. To this end, there is provided a method for detecting tramp material in an inertia cone crusher comprising an outer crushing shell and an inner crushing shell, said inner and outer shells forming between them a crushing chamber, the inner crushing shell being supported on a crushing head, said crushing head being rotatably connected to an unbalance bushing, which is arranged to be rotated by a drive shaft, said unbalance bushing being provided with an unbalance weight for tilting the unbalance bushing when it is rotated, such that the central axis of the crushing head will, when the unbalance bushing is rotated by the drive shaft and tilted by the unbalance weight, gyrate about a gyration axis, the inner crushing shell thereby approaching the outer crushing shell for crushing material in the crushing chamber, the method comprising measuring at least one of a position and a motion of the crushing head;

obtaining, based on said measurement, a gyration value, said gyration value being indicative of at least one of an inclination of the gyration axis in relation to a reference line, a shape of the gyrating motion of the central axis of the crushing head, an amplitude of the gyrating motion of the central axis of the crushing head, and an inclination of the central axis of the crushing head in relation to a reference line;

comparing said gyration value with a gyration reference value; and determining, based on said comparison, whether to issue a tramp material warning signal indicating the presence of tramp material in the crusher. This method allows for the detection of tramp material as it passes through the crushing chamber, such that appropriate actions for dealing with the tramp material may be taken.

According to an embodiment, the obtaining of said gyration value comprises low-pass filtering a signal from a sensor, and/or forming an average of values obtained from a sensor. Thereby, the gyration value may be cleared of any fluctuations caused by material to be crushed or the rotation of the crushing head.

According to an embodiment, said gyration reference value is determined based on a previously obtained gyration value. The method will thereby allow the detection of any seemingly unmotivated changes of the gyration behaviour of the crushing head, without the need for detailed a priori knowledge of an expected behaviour, said changes being indicative of a potential tramp material event.

According to an embodiment, said tramp material warning signal is issued based on the inclination of the gyration axis exceeding a reference inclination, and/or the amplitude of the gyrating motion of the crushing head passing a reference amplitude. These two conditions are relatively simple to detect, and are relatively strong indicators of the occurrence of a tramp material event.

The issuing of a tramp material warning signal may be used for triggering an action for remedying the effect of the presence of tramp material in the crushing chamber. Hence, according to an embodiment, the method comprises reducing, based on said tramp material warning signal, the RPM of the drive shaft and/or or the power delivered via the drive shaft. According to another embodiment, the method comprises issuing, based on said tramp material warning signal, an audible, visible, and/or sensory tramp material warning signal to an operator. According to yet another embodiment, the method comprises initiating, based on said tramp material warning signal, a tramp material removal procedure for separating the tramp material from a flow of crushed material downstream of the crushing chamber.

According to an embodiment, the method comprises determining, based on the gyration value, the location of the tramp material in the crushing chamber. This facilitates removing the tramp material by any automatic means. The method may also comprise indicating the location to an operator, such that the operator may remove it manually or take any other appropriate action.

According to an embodiment, the method comprises obtaining a power value indicative of the power delivered to the crushing head via the drive shaft; and comparing said power value with a power reference value, wherein said determination whether to issue a tramp material warning signal is also based on the comparison of the power value with the power reference value. The presence of tramp material in the crushing chamber also affects the power consumption of the crusher; hence, the power consumption can be used as a supplementary indicator, for increasing the reliability of the tramp material detection. The power reference value may, according to an embodiment, be determined based on a previously obtained power value. Hence, a sudden decrease of the power consumption may, provided that it is not motivated by a decrease of the flow into the crusher of material to be crushed, or of the RPM of the crusher, indicate that a tramp material event has occurred.

According to an embodiment, said gyration value is indicative of the inclination of the central axis of the crushing head. The inclination may be used for obtaining a tramp material indication when the crusher is in operation. Alternatively, or as a supplementary indication, a single value of the inclination may be used for determining the presence of tramp material in the crushing chamber when the crushing head is at rest. Thereby, any accidental re-starting of a stopped crusher having tramp material therein may be avoided.

According to another aspect of the invention, there is provided an inertia cone crusher comprising an outer crushing shell and an inner crushing shell, said inner and outer shells forming between them a crushing chamber, the inner crushing shell being supported on a crushing head, said crushing head being rotatably connected to an unbalance bushing, which is arranged to be rotated by a drive shaft, said unbalance bushing being provided with an unbalance weight for tilting the unbalance bushing when it is rotated, such that the central axis of the crushing head will, when the unbalance bushing is rotated by the drive shaft and tilted by the unbalance weight, gyrate about a gyration axis, the inner crushing shell thereby approaching the outer crushing shell for crushing material in the crushing chamber, the crusher further comprising a sensor for sensing at least one of a position and a motion of the crushing head, and a controller configured to obtain a gyration value and determine whether to issue a tramp material warning signal according to any of the methods described hereinbefore. Such a crusher is capable of detecting the presence of tramp material in the crushing chamber.

According to an embodiment, the inertia cone crusher comprises a power sensor for obtaining a power value indicative of the power delivered to the crushing head via the drive shaft, wherein the controller is configured to obtain a power value indicative of the power delivered to the crushing head via the drive shaft; and compare said power value with a power reference value, wherein said determination whether to issue a tramp material warning signal is also based on the comparison of the power value with the power reference value.

According to an embodiment, the inertia cone crusher further comprises a plurality of hatches for accessing the crushing chamber, each of said hatches allowing removal of tramp material therethrough; and means for indicating the location of tramp material to an operator, so as to assist said operator in selecting the correct hatch to open.

BRIEF DESCRIPTION OF THE DRAWINGS

The invention is described in more detail below with reference to the appended drawings in which.

DESCRIPTION OF PREFERRED EMBODIMENTS

Figure 1:
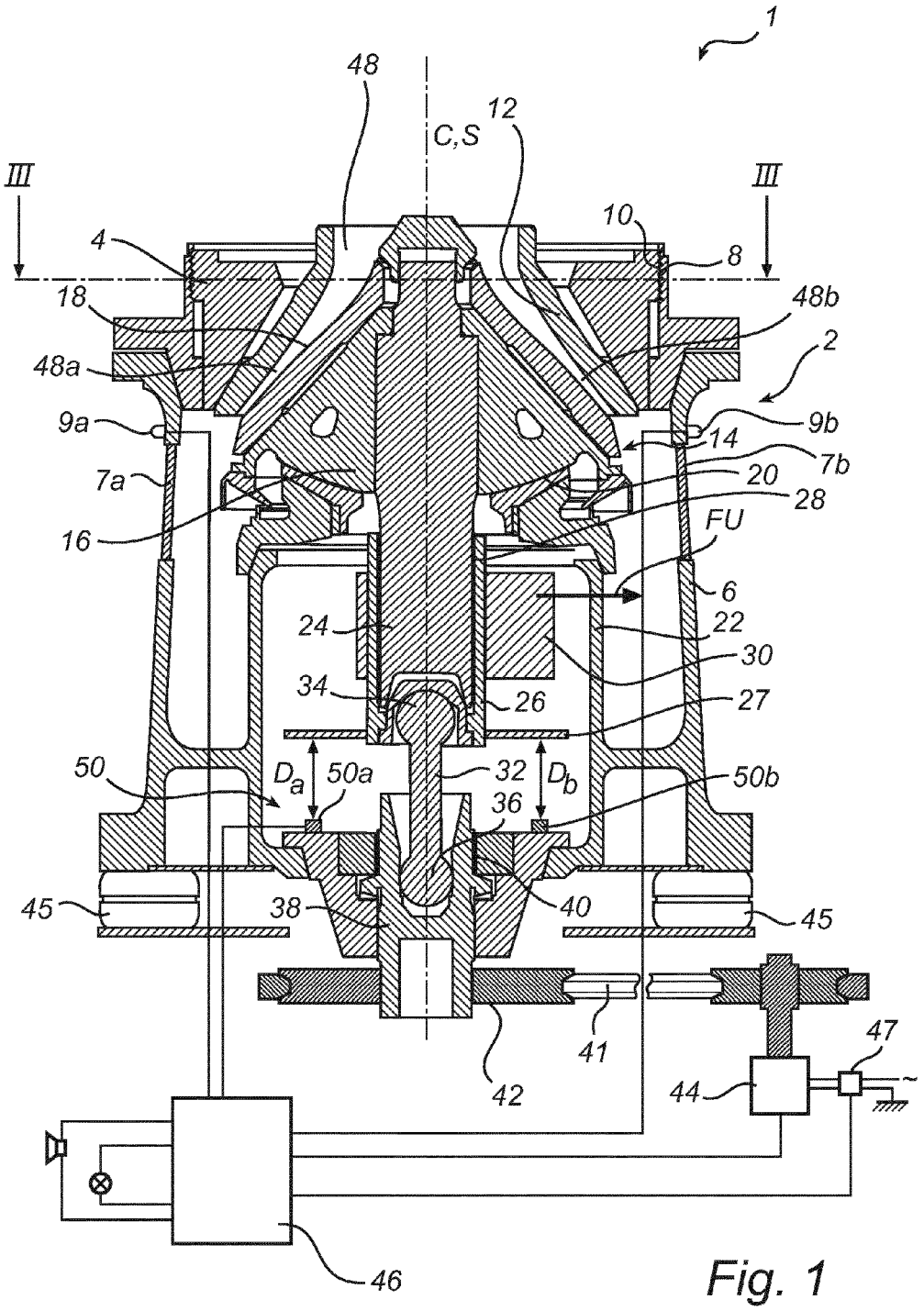
FIG. 1 is a schematic side view, in cross-section, of an inertia cone crusher.

FIG. 1 illustrates an inertia cone crusher 1 in accordance with one embodiment of the present invention. The inertia cone crusher 1 comprises a crusher frame 2 in which the various parts of the crusher 1 are mounted. The crusher frame 2 comprises an upper frame portion 4, and a lower frame portion 6. The upper frame portion 4 has the shape of a bowl and is provided with an outer thread 8, which co-operates with an inner thread 10 of the lower frame portion 6. The upper frame portion 4 supports, on the inside thereof, an outer crushing shell 12. The outer crushing shell 12 is a wear part which may be made from, for example, a manganese steel.

The lower frame portion 6 supports an inner crushing shell arrangement 14. The inner crushing shell arrangement 14 comprises a crushing head 16, which has the shape of a cone and which supports an inner crushing shell 18, which is a wear part that can be made from, for example, a manganese steel. The crushing head 16 rests on a spherical bearing 20, which is supported on an inner cylindrical portion 22 of the lower frame portion 6.

The crushing head 16 is mounted on a crushing head shaft 24. At a lower end thereof, the crushing head shaft 24 is encircled by an unbalance bushing 26, which has the shape of a cylindrical sleeve. The unbalance bushing 26 is provided with an inner cylindrical bearing 28 making it possible for the unbalance bushing 26 to rotate relative to the crushing head shaft 24 about a central axis S of the crushing head 16 and the crushing head shaft 24. A gyration sensor reflection disc 27, the function of which will be described in more detail below, stretches radially out from, and encircles, the unbalance bushing 26.

An unbalance weight 30 is mounted on one side of the unbalance bushing 26. At its lower end the unbalance bushing 26 is connected to the upper end of a vertical transmission shaft 32 via a universal joint 34. Another universal joint 36 connects the lower end of the vertical transmission shaft 32 to a drive shaft 38, which is journalled in a drive shaft bearing 40. Rotational movement of the drive shaft 38 can thus be transferred from the drive shaft 38 to the unbalance bushing 26 via the vertical transmission shaft 32, while allowing the unbalance bushing 26 and the vertical transmission shaft 32 to be displaced from a vertical reference axis C during operation of the crusher.

A pulley 42 is mounted on the drive shaft 38, below the drive shaft bearing 40. An electric motor 44 is connected via a belt 41 to the pulley 42. According to one alternative embodiment the motor may be connected directly to the drive shaft 38.

The crusher 1 is suspended on cushions 45 to dampen vibrations occurring during the crushing action.

The outer and inner crushing shells 12, 18 form between them a crushing chamber 48, to which material that is to be crushed is supplied. The discharge opening of the crushing chamber 48, and thereby the crushing capacity, can be adjusted by means of turning the upper frame portion 4, by means of the threads 8, 10, such that the vertical distance between the shells 12, 18 is adjusted.

When the crusher 1 is in operation the drive shaft 38 is rotated by means of the motor 44. The rotation of the drive shaft 38 causes the unbalance bushing 26 to rotate and as an effect of that rotation the unbalance bushing 26 swings outwards, in the direction of the unbalance weight 30, displacing the unbalance weight 30 further away from the vertical reference axis C, in response to the centrifugal force to which the unbalance weight 30 is exposed. Such displacement of the unbalance weight 30, and of the unbalance bushing 26 to which the unbalance weight 30 is attached, is allowed thanks to the flexibility of the universal joints 34, 36 of the vertical transmission shaft 32, and thanks to the fact that the sleeve shaped unbalance bushing 26 may slide somewhat on the crushing head shaft 24 in the axial direction of the cylindrical bearing 28. The combined rotation and swinging of the unbalance bushing 26 causes an inclination of the crushing head shaft 24, and makes the central axis S of the crushing head 16 and the crushing head shaft 24 gyrate about the vertical reference axis C, such that material is crushed in the crushing chamber 48 between the outer and inner crushing shells 12. Hence, under normal operating conditions, a gyration axis G, about which the crushing head 16 and the crushing head shaft 24 will gyrate, coincides with the vertical reference axis C. In FIG. 1 the crusher 1 is shown inoperative, i.e. in a non-gyrating state, and with the central axis S of the crushing head 16 and the crushing head shaft 24 coinciding with the vertical reference axis C.

A control system 46 is configured to control the operation of the crusher 1. The control system 46 is connected to the motor 44, for controlling the power and/or the RPM of the motor 44. A frequency converter 47, for driving the motor 44, is connected between the electric power supply line and the motor 44. The frequency converter 47 is configured to measure the electric power consumed by the motor 44 for rotating the drive shaft 38, and hence acts as a power sensor. The frequency converter 47 is also configured to measure the rotation frequency (RPM) of the motor 44. The readings of the frequency converter 47 are received by the control system 46. Furthermore, the control system 46 is connected to and receives readings from a gyration sensor 50, which senses the location or motion of the gyration sensor reflection disc 27. By way of example, the gyration sensor 50 may comprise three separate sensing elements, which are distributedly mounted in a horiPMontal plane beneath the gyration sensor reflection disc 27, for sensing three vertical distances to the gyration sensor reflection disc 27 in the manner described in detail in EP2116307. Thereby, a complete determination of the tilt of the gyration sensor reflection disc 27, and hence also of the direction of the crushing head central axis S, may be obtained. In the section of FIG. 1, two sensing elements 50*a*, 50*b* of the sensor 50, for measuring two respective distances $D_a$, $D_b$, are illustrated; the third sensor is not visible in the section. In fact, the two distances $D_a$, $D_b$, obtained by the two sensors 50*a*, 50*b*, may, if an additional constraint on the motion of the crushing head 16 or the crushing head shaft 24 is known, suffice for obtaining the direction of the crushing head central axis S. The spherical bearing 20 limits the degrees of freedom of the motion of the crushing head 16, and thereby forms such a constraint.

The sensor 50 may be configured to obtain the direction of the central axis S in the manner described above. Alternatively, the sensor 50 may comprise only one single sensing element 50*a* for sensing the distance $D_a$ to one single point on the gyration sensor reflection disc 27. Thereby, the amplitude $A_{Da}$ of the vertical movement of that particular portion on the gyration sensor reflection disc 27 may be obtained, said amplitude $A_{Da}$ of vertical movement representing the projection of the gyration amplitude onto a vertical line passing through said point and the sensing element 50*a*.

For non-contact sensing of the distances $D_a$, $D_b$ to the gyration sensor reflection disc, the gyration sensor 50 may, for example, comprise a radar, an ultrasonic transceiver, and/or an optical transceiver. The gyration sensor 50 may also, or as an alternative, operate by mechanical contact with the gyration sensor reflection disc 27.

In alternative embodiments, the gyration sensor 50 may be configured to sense the absolute or relative location of other parts of the unbalance bushing 26, the crushing head 16, or any components attached thereto.

In yet alternative embodiments, the gyration sensor 50 may be configured to sense the motion of the unbalance bushing 26, the crushing head 16, or any components attached thereto, e.g. by means of an accelerometer or a doppler radar.

Two hatches 7*a*, 7*b* in a side wall of the lower frame portion 6 each permit access to at least a respective portion 48*a*, 48*b* of the crushing chamber 48 from below. Each hatch 7*a-b* is associated with a respective lamp 9*a*, 9*b*. The lamps 9*a*, 9*b* are connected to the control system 46.

Figure 2:
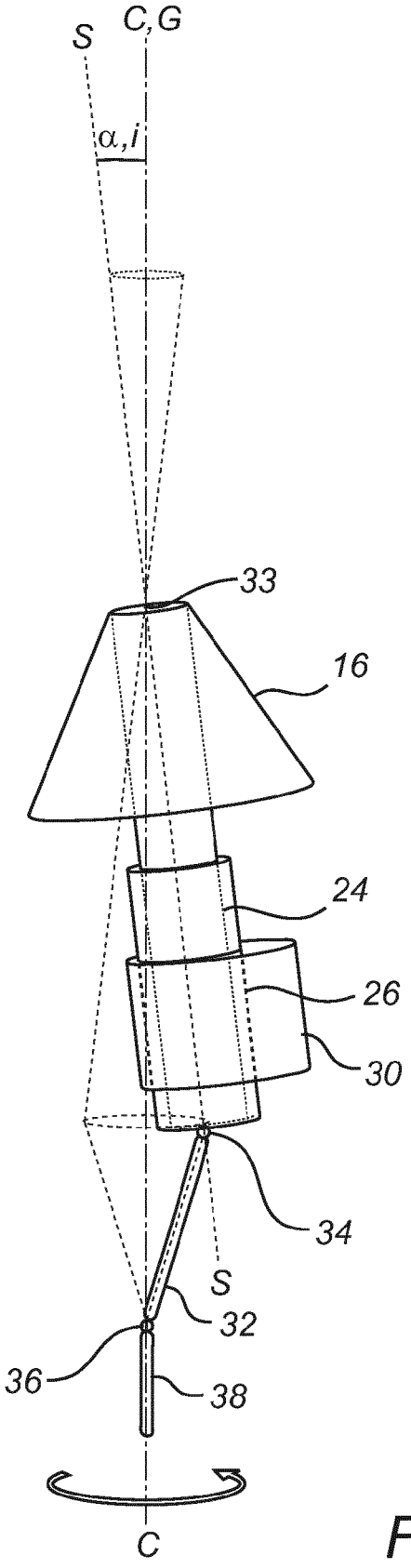
FIG. 2 is a schematic side view of the crushing head and the crushing head transmission parts of an inertia cone crusher.

FIG. 2 illustrates the gyrating motion of the central axis S of the crushing head shaft 24 and the crushing head 16 about the gyration axis G during normal operation of the crusher 1. For reasons of clarity, only the rotating parts are schematically illustrated. As the drive shaft 38 rotates the vertical transmission shaft 32 and the unbalance bushing 26, the unbalance weight 30 makes the unbalance bushing 26 swing out radially, thereby tilting the central axis S of the crushing head 16 and the crushing head shaft 24 relative to the vertical reference axis C by an inclination angle i. As the tilted central axis S is rotated by the drive shaft 38, it will follow a gyrating motion about the gyration axis G, the central axis S thereby acting as a generatrix generating two cones meeting at an apex 33. An angle $\alpha$, formed at the apex 33 by the central axis S of the crushing head 16 and the gyration axis G, will vary depending on the mass of the unbalance weight 30 (FIG. 1), the RPM at which the unbalance weight 30 is rotated, and the type and amount of material that is to be crushed. The faster the drive shaft 38 rotates, the more the unbalance bushing 26 will tilt the central axis S of the crushing head 16 and the crushing head shaft 24. Under the normal operating conditions illustrated in FIG. 2, the instantaneous inclination i of the crushing head 16 relative to the vertical axis C coincides with the apex angle $\alpha$ of the gyrating motion. This may not always be the case, as will be described further below.

Figure 3A:
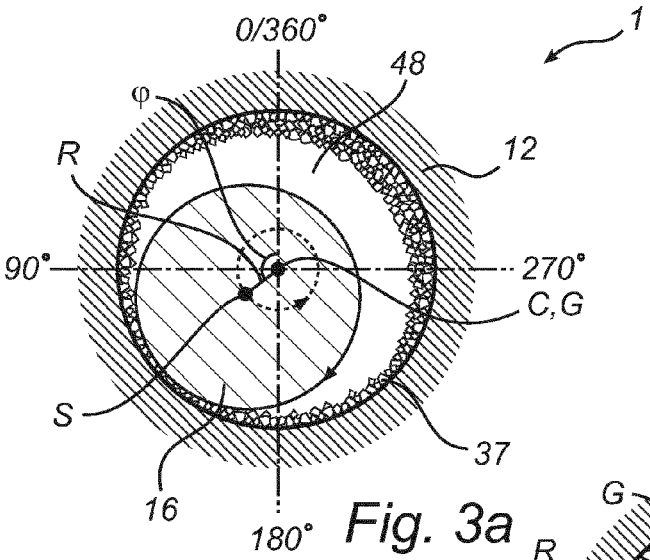
FIGS. 3*a-e* are schematic top views, in cross-section, of a crusher as seen in the direction of arrows III-III of FIG. 1.

In the cross section of FIG. 3*a*, which is taken along the line III-III of FIG. 1, the normal operating condition of the crusher 1 is schematically illustrated. For reasons of clarity, the crushing head shaft 24, the crushing head 16, and the inner crushing shell 18 are illustrated as an integral unit 16. A pair of crossed, dashed lines are added to the figure to aid the eye to the geometric centre of the outer crushing shell 12, at which the vertical reference line C is illustrated, and about which the crushing head 16 gyrates. The crossed, dashed lines define a system of polar coordinates in the plane of FIG. 3*a*, with the pole coinciding with the geometric centre of the outer crushing shell 12, and with four quadrants of the coordinate system as illustrated in FIG. 3*a*, the sector 0-90° defining a first quadrant; the sector 90-180° defining a second quadrant; the sector 180-270° defining a third quadrant; and the sector 270-360° defining a fourth quadrant. The angular component of the polar coordinates of the central axis S is denoted by $\phi$, and the coordinate system is, for the sake of simplicity, oriented such that the central axis S of the crushing head 16, under tramp material free operating conditions, will move in a positive angular direction.

Under such normal operating conditions, material to be crushed 37 is present in the crushing chamber 48. Even though only a relatively thin layer of material to be crushed 37 is illustrated in FIG. 3*a*, it will be appreciated that during operation, the crushing chamber 48 may be more or less completely filled with material to be crushed.

When the drive shaft 38 (FIG. 1) rotates the unbalance bushing 26 such that the crushing head 16 gyrates, the crushing head 16 will roll against the material to be crushed 37 present in the crushing chamber 48. As the crushing head 16 rolls against the material to be crushed 37 at a distance from the periphery of the outer crushing shell 12, the central axis S of the crushing head 16, about which axis the crushing head 16 rotates, will follow a circular path about the gyration axis G. Under the normal operating condition of FIG. 3*a*, the gyration axis G coincides with the vertical reference axis C. During a complete revolution, the central axis S of the crushing head 16 passes from 0-360°, i.e. from quadrant to quadrant of the polar coordinate system, at a uniform speed, and at a static distance from the vertical reference axis C.

During operation, the gyration sensor 50 (FIG. 1) senses the instantaneous inclination i of the central axis S of the crushing head 16 in relation to the vertical reference axis C, and based on the measurement, the control system calculates the direction of the gyration axis G and an amplitude $A_\alpha$ of the gyration. The crushing head central axis S, the gyration axis G, and the vertical reference axis C may be represented as vectors in space. The gyration axis G is, in this example, defined as the time-average direction of the crushing head central axis S over an entire revolution. The amplitude $A_\alpha$ of the gyration is in this example calculated as the time average, over an entire revolution, of the tilt angle $\alpha$ (FIG. 2) of the crushing head central axis S relative to the gyration axis G. Alternatively, the tilt angle $\alpha$ may be used directly as a measure of amplitude, without averaging. The tilt angle $\alpha$ (FIG. 2) corresponds, at the illustrated cross-section, to a radial distance R between the crushing head central axis S and the to the gyration axis G. Hence, also R, or a time average of R, could be used as a measure of amplitude.

Figure 3B:
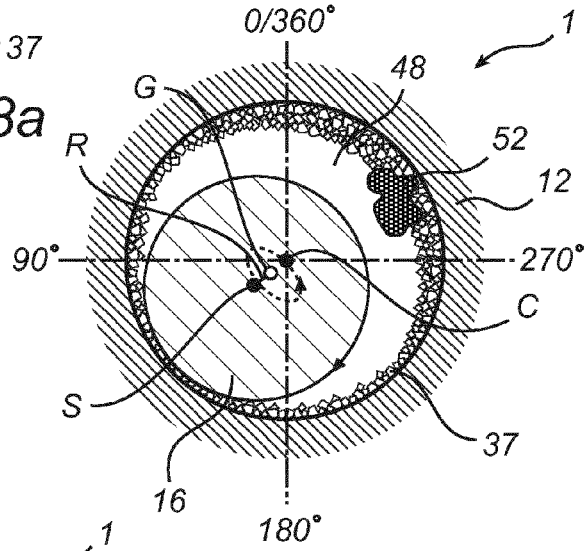

Turning now to FIG. 3*b*, a relatively moderately siPMed piece of uncrushable tramp material 52, such as a digging tooth from an excavator, has entered the crushing chamber 48 from equipment upstream of the crusher 1. Again, also crushable material 37 is present in the crushing chamber 48. Even though the distribution of crushable material 37 in the crushing chamber 48, for reasons of simplicity, is illustrated as being similar to that of FIG. 3*a*, it will be appreciated that parts of the crushable material 37 near the tramp material 52 may be shielded by the tramp material 52 from being crushed. The piece of tramp material 52 differs from the material to be crushed 37 in that the tramp material 52 will not yield to the crushing head 16, but will instead deflect the gyrating crushing head 16, so as to constrain its motion. The dashed oval line of FIG. 3*b* illustrates the constrained path of the central axis S of the crushing head 16. The constraint introduced by the piece of tramp material 52 results in the gyration axis G being tilted relative to the vertical reference axis C by an angle $\beta$, which will be further described below with reference to FIG. 4. As can be seen in FIG. 3*b*, the presence of tramp material 52 in the crushing chamber 48 also causes the shape of the gyrating motion of the crushing head axis S about the gyration axis G to change, so as to form a non-circular generatrix. In the particular example of FIG. 3*b*, the central axis S of the crushing head 16 "skips" the fourth quadrant, and follows a path that is constrained to quadrants 1-3; in fact, it skips the entire sector defined by the angular interval from about 220° to about 50°. Furthermore, the piece of tramp material 52 causes the amplitude $A_\alpha$ of the gyrating motion to change, said amplitude $A_\alpha$ being formed by time averaging the angle $\alpha$ (FIG. 2), the angle $\alpha$ being represented in the plane of FIG. 3*b* by the radial distance R.

Figure 3C:
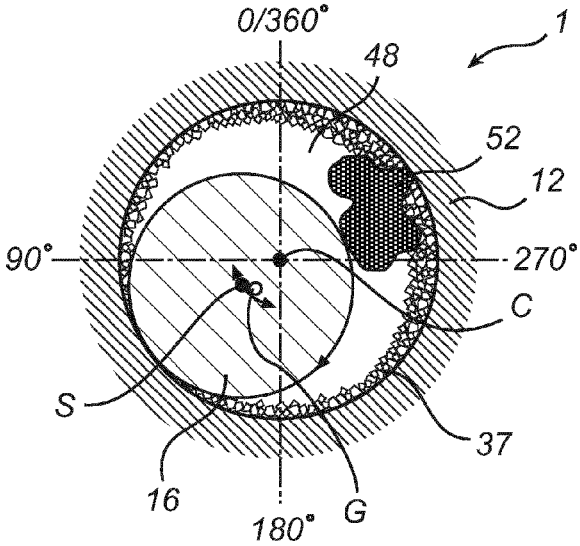

Hence, the control system 46 may detect the presence of tramp material either based on the change of shape of the gyrating motion of the crushing head central axis S to a non-circular shape, e.g. by comparing the highest value of the angle $\alpha$ with the lowest value of said angle detected during a complete revolution of the gyrating motion of the crushing head 16; or based on the direction of the gyration axis G deviating from the direction of the vertical reference axis C; or based on the value of the inclination angle $\beta$ (FIG. 4) of the axis of gyration G relative to the vertical reference axis C surpassing a reference inclination value; or based on the central axis S of the crushing head 16 following a path, as seen in the planar polar coordinates of FIG. 3*b*, that skips a sector angle defined by an angular interval, an entire quadrant, or, as will be illustrated with reference to FIG. 3*c*, even multiple quadrants; or based on the gyration amplitude $A_\alpha$ passing a reference amplitude expected for the particular operating conditions; or based on a combination of any of the above. A detection method combining a plurality of the above indicators gives the most reliable tramp material indication.

An additional, supplementary indicator that a tramp material event has occurred is that the power required for rotating the drive shaft 38 (FIG. 1) temporarily diminishes. This is due to the fact that the tramp material 52 shields material to be crushed, which is present near the piece of tramp material 52, from being crushed by the crushing head 16. Thereby, the rolling friction between the crushing head 16 and the outer crushing shell 12, via the material to be crushed, is reduced, which reduces the power consumption of the motor 44. For a crusher designed to operate at various values of the RPM, a reduction of the power scaled by the RPM, i.e. a reduction of the quotient $P_M/F_M$, $P_M$ representing the power and $F_M$ representing the RPM of the motor 44, forms an even more accurate criterion for a supplementary tramp material indication.

Turning to FIG. 3*c*, a large piece of uncrushable tramp material 52 is present in the crushing chamber 48. Again, also crushable material 37, illustrated as a layer along the outer crushing shell 12, is present in the crushing chamber 48. Compared to the situation of FIG. 3*b*, the piece of tramp material 52 of FIG. 3*c* constrains the motion of the crushing head 16 even further, such that the deformed path of the crushing head 16 has almost degenerated into a curved line, which is entirely confined to the second quadrant of the coordinate system of FIG. 3*c*. The curved arrow attached to the central axis S of the crushing head 16 approximately illustrates the constrained path of the central axis S. The constraint introduced by the large piece of tramp material 52 results in the crushing head 16 pressing away the crushable material 37 from the inner wall of the outer crushing shell 12 opposite to the tramp material 52, such that the inclination i (FIG. 2) of the central axis S of the crushing head 16 increases.

The constraint introduced by the piece of tramp material 52 also results in the gyration axis G, still defined as the average direction of the central axis S of the crushing head 16, being tilted relative to the vertical reference axis C, and in a reduction of the average value of the apex angle $\alpha$.

Hence, the control system 46 may detect the presence of tramp material 52 not only based on those tramp material indicators discussed hereinbefore with reference to FIG. 3*b*, but also based on an increase of the instantaneous or average crushing head inclination i; or based on a reduction of the average apex angle α; or based on any combination of those, and any combination with any of those indicators discussed with reference to FIG. 3*b*. All the above indicators may be combined with the supplementary indication provided by a power reduction, similar to what has been described above with reference to FIG. 3*b*, for increasing the accuracy of the indication.

Figure 3D:
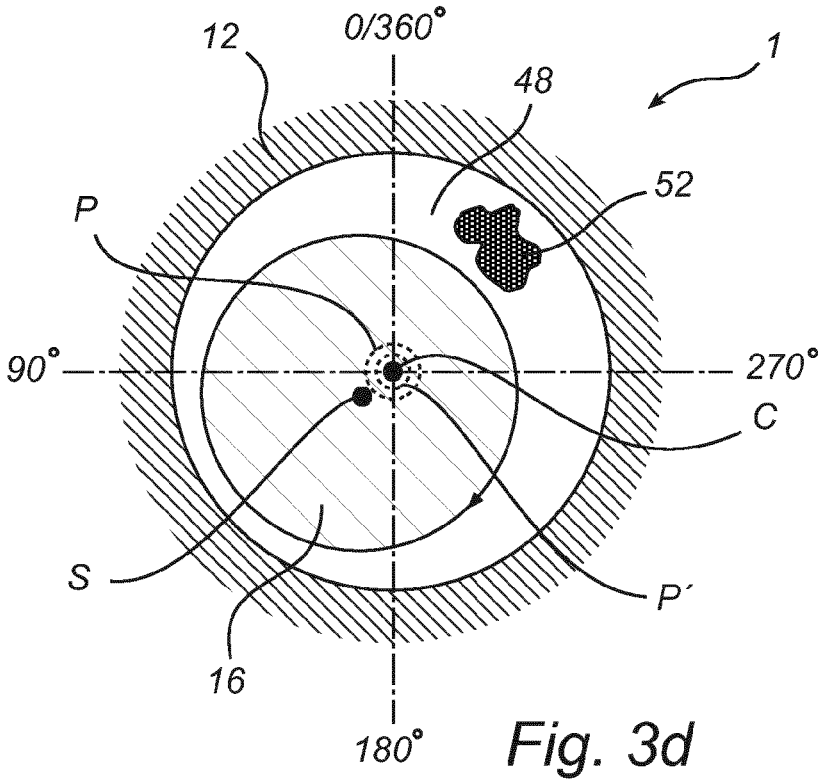

FIG. 3*d* illustrates the tramp material situation of FIG. 3*b* when the crusher 1 has been stopped, and the crushing head 16 has come to a rest. As the crusher may be stopped with or without crushable material therein, the crusher of FIG. 3*d* is illustrated without any such material. The crushing head 16 leans onto the piece of tramp material 52, such that the tramp material 52 maintains the central axis S of the crushing head 16 at a tilt relative to the central axis' S expected rest position. The central axis S of the crushing head 16 may, due to the unbalance weight, and due to the properties of any material to be crushed in the crushing chamber 48, be expected to come to rest anywhere within an expected stop area defined by the dashed circle P.

Figure 3E:
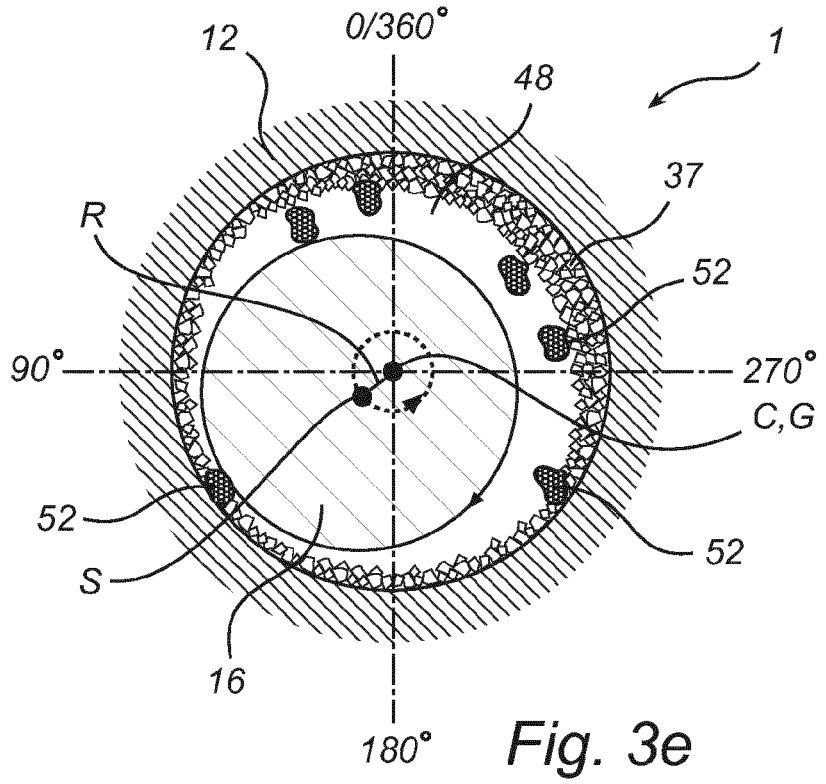

FIG. 3*e* illustrates the gyration of the crushing head 16 in the case of multiple small, uncrushable tramp material pieces 52 entering the crushing chamber 48. As the pieces 52 will generally be distributed relatively evenly in the crushing chamber 48 about the crushing head 16, no tilt of the gyration axis will occur; the tramp event will only be detected by measuring the amplitude Aα (illustrated in the cross section by the radial distance R) of the crushing head's 16 gyrating motion, possibly in combination with the detection of a reduction of the crusher's 1 power consumption.

Figure 4:
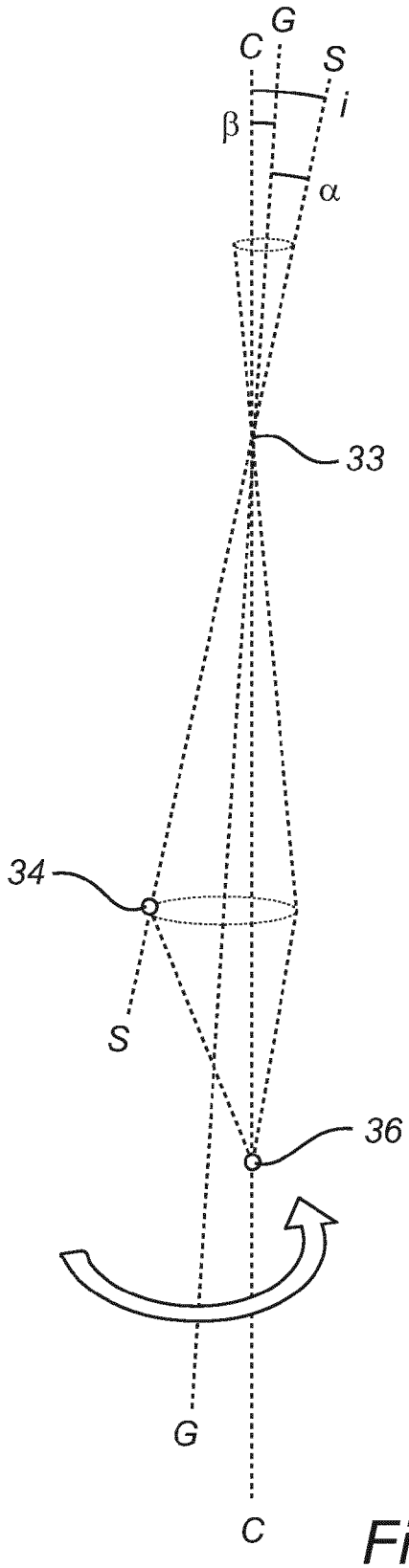
FIG. 4 is a schematic side view representing the gyrating motion of an inertia cone crusher under influence of tramp material in the crushing chamber.

FIG. 4 is a side view illustrating the motion of the crushing head central axis S about the gyration axis G, said gyration axis G being tilted relative to the vertical reference axis C by an angle β. This corresponds to the situations of FIGS. 3*b* and 3*c*, in which the gyration axis G is tilted by a piece of tramp material 52. Again, the inclination of the central axis S of the crushing head 16 relative to the vertical reference axis C is indicated by i. For reasons of clarity, all physical components are omitted in FIG. 4.

Figure 5:
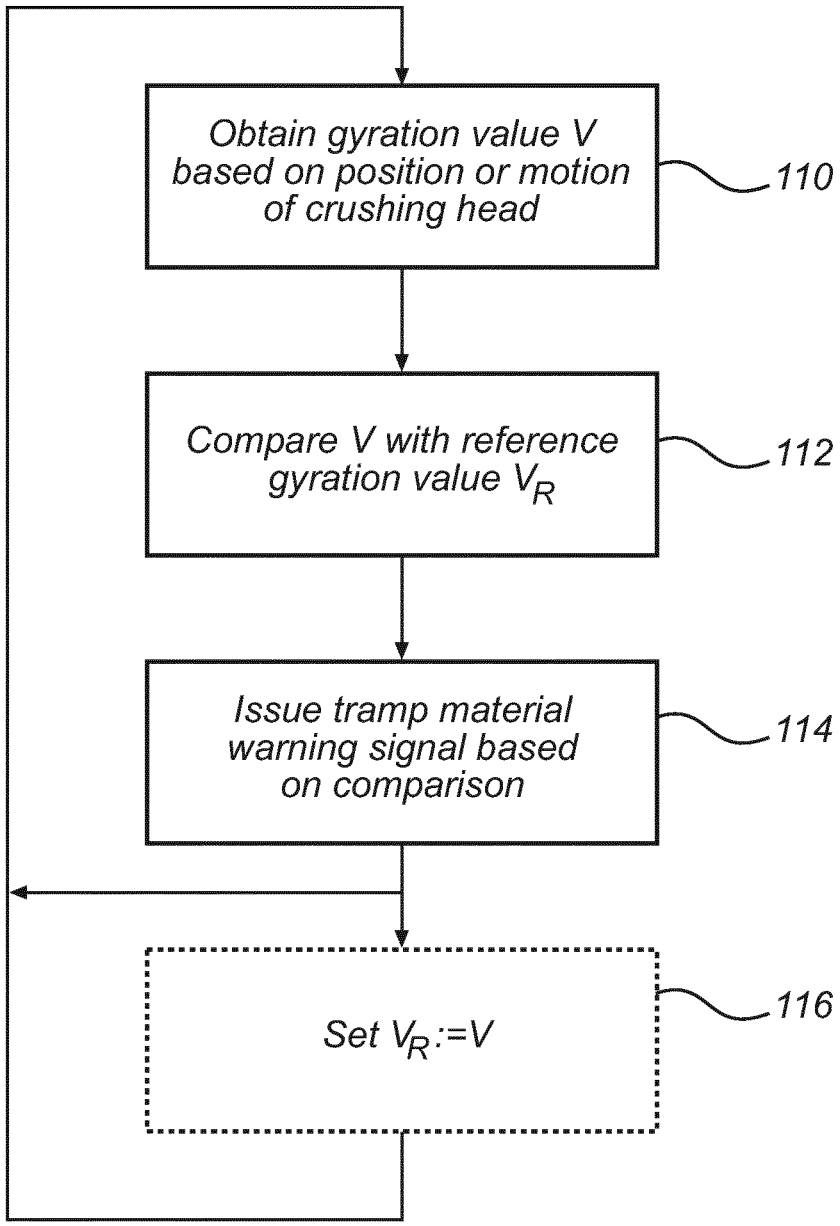
FIG. 5 is a flow chart illustrating a method for detecting tramp material.

Referring now to FIG. 5, a method for detecting tramp material in the crusher 1 of FIGS. 1-4 will now be described.

In step 110, a gyration value V, represented by, for example, the direction of the gyration axis G of the crusher 1, is obtained by the control system 46. This may be achieved by, e.g., measuring a number of values of the direction of the crushing head axis S, relative to a reference axis C, over a selected sampling time interval using the sensor 50. The individual spatial vectors obtained in this manner are summed so as to obtain an average direction, which corresponds to the direction of the gyration axis G. Preferably, at least five samples are taken over at least one complete revolution for obtaining a precise direction of the gyration axis G. In a simpler implementation, a rough estimation of the magnitude of the inclination β of the gyration axis G may be obtained by averaging only two values, e.g. the maximum and the minimum values of the tilt i of the central axis S of the crushing head 16 during a time period defined by a sliding time window of a length exceeding at least a period of rotation of the drive shaft 38.

In step 112, the gyration value V, which is in this example represented by the direction of the gyration axis G, is compared with a gyration reference value VR. The gyration reference VR value may, by way of example, be represented by the direction of the vertical reference axis C, but a person skilled in the art may select any reference axis, or any other type of gyration reference value suitable for the particular type of gyration value V.

In step 114, the control system 46 determines, based on the comparison performed in step 112, whether to issue a tramp material warning signal indicating the presence of tramp material 52 in the crusher 1. By way of example, depending on the design of the crusher 1 and the type and siPMe of tramp material 52 that should be detected, the tramp material warning signal may be issued if the angle β (FIG. 4) between the gyration axis G and the vertical reference axis C exceeds 3°. Alternatively, the control system 46 may determine that there is some reason to suspect a tramp event, but not enough reason to issue a tramp material warning signal. In such a scenario, the control system may proceed to obtain a secondary indication of tramp material, e.g. by representing the gyration value by a time average of the amplitude angle α, and comparing it to a reference gyration value following steps 110-112. If the gyration value according to both its representations, i.e. the direction of the gyration axis G and the angular amplitude a, indicate a probable tramp event, a tramp material warning signal may be issued with greater reliability in step 114.

In the example described above with reference to steps 110-114, the direction of the gyration axis G is compared with the direction of the vertical reference axis C. An alternative is to compare the direction of the gyration axis G with a previously determined direction of the gyration axis G. A fast, sudden change in the direction of the gyration axis G indicates a potential tramp material event. Hence, the method described above may comprise an optional step 116 (dashed), in which the gyration reference value VR assumes the value of a previously obtained gyration value V.

According to an embodiment providing an example of tramp material detection that is based a combination of multiple tramp indications, a good balance between complexity of implementation and reliability of tramp material indication is obtained by a method according to which:

A first tramp material indication is obtained using the method steps 110-112, wherein a first tramp material indication criterion is based on a value |i|n of the average inclination i (FIG. 2) being increased by more than 25% relative to a previously measured average inclination |i|n−1. Values of the average inclination may be obtained by continuously sampling the inclination i, and averaging the sampled values over a sliding time window in the manner well known to those skilled in the art. The average inclination |i|n represents a first gyration value V1, whereas the previous value |i|n−1 represents a gyration reference value VR1. After having compared V1 with VR1, VR1 may be given the value of V1 as explained with reference to step 116.

A second tramp material indication criterion is obtained, again using the method steps 110-112, wherein said second tramp material indication criterion is based on the total angle interval, passed by the central axis S of the crushing head in the polar coordinate system of FIGS. 3*a-e* during a complete revolution, falling below a predefined value, for example 180°, or, expressed differently, the central axis S of the crushing head 16 skipping an angle interval exceeding e.g. 180°. The skipped angle interval φS may, e.g., be obtained by continuously sampling consecutive values φn of the angle φ, and forming φS=(φn−φn−1) modulo 360°. The skipped angle interval φS represents a second gyration value V2, whereas its corresponding gyration reference value VR2 has the value of 180°.

A third tramp material indication criterion is obtained based on a sampled value PM,n/FM,n of the quotient PM/FM being reduced by more than 25% relative to a previous measurement of PM,n−1/FM,n−1. The quotient PM,n/FM,n represents a power value, and PM,n−1/FM,n−1 represents a power reference value.

If all three criteria are fulfilled, the controller 46 determines that there is a suspected tramp material event, and starts a timer, while repeatedly continuing to obtain V1, V2 and PM,n/FM,n, and comparing them to VR1, VR2 and PM,n−1/FM,n−1, respectively. In case all three tramp material indication criteria remain fulfilled during a predetermined time interval, the controller 46 determines that there is a confirmed tramp event, and issues a tramp material warning signal using the method step 114.

Clearly, instead of comparing the average inclination |i|n with a previously obtained average inclination |i|n−1, the average inclination |i|n may be compared with a predefined value. Similarly, instead of comparing the power value PM,n/FM,n with a previous power value PM,n−1/FM,n−1, also the power value PM,n/FM,n may be compared with a predefined value.

Knowledge of the direction of the gyration axis G relative to a reference axis; the shape of the gyrating motion relative to a reference shape; the angle interval skipped by the central axis S of the crushing head 16 (c.f. FIGS. 3*b-c*); or the inclination i of the central axis S of the crushing head 16, also allows for determining the location of the piece of tramp material 52 in the crushing chamber 48, since the tramp material 52 will push the crushing head 16 away from its expected location should no tramp material be present in the crushing chamber 48. Hence, the method may optionally comprise determining, based on the gyration value V, the location of the tramp material in the crushing chamber 48. By way of example, looking at FIG. 3*b*, an offset of the gyration axis G into the 2nd quadrant indicates that the piece of tramp material 52 is located in the 4th quadrant. Similarly, the central axis S of the crushing head 16 skipping the angle interval from about 220° to about 50° (c.f. the polar coordinates of FIG. 3*b*) provides the same information. The location may be indicated to an operator, such that she may easily locate and remove the piece of tramp material 52 from the crusher 1.

In yet another embodiment of the method of FIG. 5, the gyration value V is represented by an amplitude ADa of the gyrating motion of the central axis S of the crushing head 16.

In said yet another embodiment, in step 110, the amplitude ADa, representing the vertical motion of a portion of the gyration sensor reflection disc 27, may be obtained by measuring a number of values of the distance Da (FIG. 1) during a complete revolution of the gyrating motion of the crushing head 16 about the gyration axis G. ADa may be calculated by forming ADa=Max(Da) −Min(Da), wherein Max(Da) and Min(Da) represent respective maximum and minimum measured values of Da during said revolution.

In step 112, the gyration value V, represented by the amplitude ADa, is compared with a gyration reference value VR, which may be represented by a reference amplitude AR. By way of example, the reference amplitude AR may be selected, based on the crusher's 1 current load condition, from a table comprising a plurality of reference amplitudes AR1 to ARn, each reference amplitude AR1 to ARn corresponding to a particular load condition of the crusher 1, and representing an expected amplitude at that particular load condition. If the amplitude ADa falls below the reference amplitude AR expected for the current load conditions, a tramp material warning signal is issued.

Referring back again to FIG. 3*c*, according to still another embodiment of the method of FIG. 5, tramp material may be detected also when the crusher 1 has been stopped and is at rest. According to this embodiment, the presence of tramp material is, in the method steps 110-114, determined based on the inclination i (FIG. 2) or direction of the central axis S of the crushing head 16, relative to its expected inclination or direction should it be at its expected rest position P. Hence, the gyration value V is represented by the inclination i when the crusher 1 is at rest. Even though the gyration value V, represented by the inclination i, is determined when the crusher is at rest, the inclination i represents the gyration behaviour of the crusher that would occur in case the crusher 1 would be restarted.

Under typical operating conditions, the crusher 1 is filled with crushable material when stopped. The gradual reduction of the excursion of the crushing head 16, as the crusher gradually spins down, allows crushable material to settle in the crushing chamber 48. Therefore, the expected rest position of the central axis S of the crushing head 16, for a cone crusher 1 having crushable material therein, is located relatively near the vertical reference axis C, within the circle P. The gyration reference value VR is thereby represented by the circle P. Hence, any tilt of the central axis S of the crushing head 16 outside the circle P indicates the possibility of tramp material being present in the crushing chamber 48.

Should the crusher be empty when it comes to rest, the unbalance weight 30 (FIG. 1) will cause the crushing head 16 to tilt somewhat as it rests inactive onto the spherical bearing 20. This is illustrated in FIG. 3*c* by a set of expected rest positions along a dashed circular line P' about the vertical reference axis C; the central axis S of the crushing head 16 may stop at any of the expected rest positions P' depending on the orientation of the unbalance weight when the crusher comes to rest. Under such conditions, the gyration reference value VR is represented by the set of all possible crushing head inclinations that place the central axis S of the crushing head 16 anywhere along the circle P'. Should the central axis S of the crushing head 16, when the crusher is empty, come to rest at an inclination i that does not coincide with any expected rest position P', this also indicates the possibility of tramp material being present in the crushing chamber 48. Depending on the weight and axial offset of the unbalance weight, the radius of the circle P' may be larger or smaller than the radius of the circle P.

Referring back again to FIG. 1, in the event that tramp material is detected in the crushing chamber 48 and the crusher 1 is stopped with crushable material therein, the direction of the inclination, when the crushing head 16 has come to rest, indicates the location of the tramp material in the crushing chamber 48. By way of example, should the central axis S of the crushing head 16 tilt to the right, relative to the vertical reference axis C, this is an indication of tramp material in the right portion 48*b* of the crushing chamber 48. The control system 46 is configured to determine the location of the tramp material based on a crushing head inclination signal from the gyration sensor 50. After having determined the location, the control system indicates the location to the operator by lighting up the right lamp 9*b* associated with the right hatch 7*b*. Thereby, the operator knows that she should look for the tramp material behind the right hatch 7*b*. Clearly, also other indication means than a lamp may be used for identifying a hatch 7 to an operator Even though only two hatches 7*a*, 7*b* are visible in the section of FIG. 1, it will be appreciated that the crusher 1 may be provided with a larger number of hatches 7 around its periphery, and each hatch may be associated with means for indicating the presence of tramp therebehind. Preferably, the crusher 1 is equipped with between two and ten hatches distributed along its periphery.

Also other measures than those used in the method embodiments described in detail above, with reference to FIG. 5, may be used as gyration values V for representing the position or gyrating motion of the crushing head 16 in a method for detecting tramp material. By way of example, a gyration value V representing the shape of the gyrating motion may be used, since a non-circular gyration of the crushing head central axis S may be an indicator of the presence of tramp material 52 in the crushing chamber 48.

Any of the above methods may be combined with each other, and/or with power monitoring as an additional indicator, thereby increasing the reliability of tramp material detection.

After having detected the presence of tramp material 52 in the crushing chamber 48, corrective measures may be taken. By way of example, the warning signal may be notified to an operator such that the operator may respond to it, and/or the control system 46 may automatically reduce the RPM of and/or power delivered by the drive shaft 38 in order to minimiPMe the risk of damage to the crusher 1. The tramp material warning signal may also be sent to any downstream equipment, such that the downstream equipment may take the required action to automatically remove the tramp material 52 from the flow of crushed material, e.g. by diverting a selected portion of the flow. Furthermore, the tramp material warning signal may be sent to any upstream equipment, so as to reduce or stop the feed of material to be crushed to the crusher 1.

It will be appreciated that numerous variants of the embodiments described above are possible within the scope of the appended claims. For example, the use of a gyration sensor reflection disc 27 has been described above. However, the motion or position of the crushing head 16 may be measured based on the detection of other parts of the crushing head 16, the crushing head shaft 24, or any device connected thereto. Other types of sensors may be used instead of a reflection disc, such as an accelerometer, a camera, or any other suitable means for detecting the position or motion of the crushing head 16.

Above, flexible joints 34, 36 of the universal joint type have been described. However, the crushing head of an inertia cone crusher may be driven via other types of flexible joints.

Hereinbefore, an inertia cone crusher 1 having an unbalance weight 30 attached to the unbalance bushing 26 has been described. In other inertia cone crusher designs, the unbalance weight may have another location than in the crusher 1 described in detail hereinbefore; for example, the unbalance weight may, with appropriate and corresponding modifications to other parts of the crusher, be located on e.g. the crushing head shaft 24 and/or the vertical transmission shaft 32, in which cases those shafts would be unbalance bushings in the meaning of that feature of the appended claims.

Above, it has been described in detail how the distances and angles R, $\alpha$, i, A$\alpha$, and ADa may be used as measures of an amplitude of the gyrating motion of the central axis S of the crushing head 16. As will be appreciated by a person skilled in the art, also other measures indicating the magnitude of the crushing head's 16 gyrating motion may be used as an indication of an amplitude, thereby forming a gyration value based on which tramp material detection may be performed.

It has also been described how different measures of the inclination at rest, the gyration amplitude, the direction of the gyration axis G, the skipped angle $\phi$S, and the shape of the gyrating motion of the crushing head 16 may be used as gyration values. Also other measures based on the location or motion of the crushing head, said other measures forming, or enabling the determination of, a gyration value indicative of at least one of an inclination of the gyration axis, a gyrating motion shape, an amplitude of the gyrating motion, and an inclination of the crushing head, may be used for detecting tramp material.

Hereinbefore, it has been described how the crushing power and motor RPM may be obtained by means of a frequency converter. As an alternative, the crusher may be provided with a separate power and/or frequency sensing device, for example a power sensor for measuring only the power consumption, or even with no such sensing means at all.

A gyrating motion in the meaning of this disclosure need not be circular, but may, depending on crusher design and load, be e.g. elliptic, oval, or follow any other type of deformed generatrix due to constraints imposed by e.g. the design of the shape of the crushing chamber 48, or by the presence of any tramp material therein.

The invention claimed is:

1. A method for detecting tramp material in an inertia cone crusher having an outer crushing shell and an inner crushing shell, said inner and outer shells forming between them a crushing chamber, the inner crushing shell being supported on a crushing head, said crushing head being rotatably connected to an unbalance bushing, which is arranged to be rotated by a drive shaft, said unbalance bushing being provided with an unbalance weight for tilting the unbalance bushing when it is rotated, such that the central axis of the crushing head will, when the unbalance bushing is rotated by the drive shaft and tilted by the unbalance weight, gyrate about a gyration axis, the inner crushing shell thereby approaching the outer crushing shell for crushing material in the crushing chamber, the method comprising the steps of:

measuring at least one of a position and a motion of the crushing head;

obtaining, based on said measurement, a gyration value, said gyration value being indicative of at least one of an inclination of the gyration axis in relation to a reference line, a shape of a path of the gyrating motion of the central axis of the crushing head, an amplitude of the gyrating motion of the central axis of the crushing head and an inclination of the central axis of the crushing head in relation to a reference line;

comparing said gyration value with a gyration reference value;

determining, based on said comparison, whether to issue a tramp material warning signal indicating the presence of tramp material in the crusher; and determining, based on the gyration value, the location of the tramp material in the crushing chamber.

2. The method according to claim 1, wherein the step of obtaining said gyration value comprises filtering a signal from a sensor, and/or forming an average of values obtained from a sensor.

3. The method according to claim 1, wherein said gyration reference value is determined based on a previously obtained gyration value.

4. The method according to claim 1, further comprising the step of issuing, based on said tramp material warning signal, an audible, visible, or sensory tramp material warning signal to an operator.

5. The method according to claim 1, further comprising the step of initiating, based on said tramp material warning signal, a tramp material removal procedure for separating the tramp material from a flow of crushed material downstream of the crusher chamber.

6. The method according to claim 1, wherein said tramp material warning signal is issued based on the inclination of the gyration axis exceeding a reference inclination, and/or the amplitude of the gyrating motion of the crushing head passing a reference amplitude.

7. The method according to claim 1, further comprising the step of reducing, based on said tramp material warning signal, the RPM of the drive shaft and/or or the power delivered via the drive shaft.

8. The method according to claim 1, wherein said gyration value is indicative of the inclination of the central axis of the crushing head.

9. The method according to claim 1, further comprising the steps of:

obtaining a power value indicative of the power delivered to the crushing head via the drive shaft; and comparing said power value with a power reference value, wherein said determination whether to issue a tramp material warning signal is also based on the comparison of the power value with the power reference value.

10. The method according to claim 9, wherein said power reference value is determined based on a previously obtained power value.

11. The method according to claim 9, wherein said tramp material warning signal is issued based on an average inclination of the crushing head exceeding a previously measured average inclination; the central axis of the crushing head skipping a sector angle; and a power value falling below a previously obtained power value.

12. An inertia cone crusher comprising:

an outer crushing shell;

an inner crushing shell, said inner and outer shells forming between them a crushing chamber, the inner crushing shell being supported on a crushing head, said crushing head being rotatably connected to an unbalance bushing, which is arranged to be rotated by a drive shaft, said unbalance bushing being provided with an unbalance weight for tilting the unbalance bushing when it is rotated, such that the central axis of the crushing head will, when the unbalance bushing is rotated by the drive shaft and tilted by the unbalance weight, gyrate about a gyration axis, the inner crushing shell thereby approaching the outer crushing shell for crushing material in the crushing chamber;

a sensor for sensing at least one of a position and a motion of the crushing head;

a controller configured to obtain a gyration value and determine whether to issue a tramp material warning signal;

a plurality of hatches for accessing the crushing, each of said hatches allowing removal of any tramp material therethrough; and means for indicating the location of tramp material to an operator, so as to assist said operator in selecting the correct hatch to open.

13. An inertia cone crusher according to claim 12, further comprising a power sensor for obtaining a power value indicative of the power delivered to the crushing head via the drive shaft.

* * * * *